US008424500B2

(12) United States Patent
David et al.

(10) Patent No.: US 8,424,500 B2
(45) Date of Patent: Apr. 23, 2013

(54) HARMONIC DRIVE CAMSHAFT PHASER WITH IMPROVED RADIAL STABILITY

(75) Inventors: Pascal David, Junglinster (LU); Sebastien Stoltz-Douchet, Lorraine (FR); Pierre Kimus, Attert (BG); Michael J. Fox, Stafford, NY (US)

(73) Assignee: Delphi Technologies, Inc., Troy, MI (US)

( * ) Notice: Subject to any disclaimer, the term of this patent is extended or adjusted under 35 U.S.C. 154(b) by 339 days.

(21) Appl. No.: 12/848,599

(22) Filed: Aug. 2, 2010

(65) Prior Publication Data

US 2011/0030632 A1 Feb. 10, 2011

Related U.S. Application Data

(63) Continuation-in-part of application No. 12/536,575, filed on Aug. 6, 2009.

(60) Provisional application No. 61/253,982, filed on Oct. 22, 2009.

(51) Int. Cl.
*F01L 1/34* (2006.01)

(52) U.S. Cl.
USPC ..... 123/90.17; 123/90.15

(58) Field of Classification Search ..... 123/90.15, 123/90.17, 90.31
See application file for complete search history.

(56) References Cited

U.S. PATENT DOCUMENTS 7,421,990 B2 9/2008 Taye et al.
2005/0199201 A1* 9/2005 Schafer et al. ..... 123/90.17

* cited by examiner

*Primary Examiner* — Zelalem Eshete
(74) *Attorney, Agent, or Firm* — Thomas N. Twomey

(57) ABSTRACT

Improved stiffening and minimized distortion of a housing for an eVCP achieved by forming a plurality of radial housing stiffeners into the housing around the motor mount end and into the eVCP's hub. A back plate is press fit into the rear of the housing, and a straight axial knurl is applied to the surface of the back plate or housing, which knurl permits a larger tolerance-higher press fit class to be used without resulting in significant deformation of the housing. The knurled back plate is harder than the housing, causing the high points of the knurl to plastically deform or plow the housing material during assembly, resulting in less radial deformation of the bore and the journal bearing. An interface between the housing and the hub provides a journal bearing interface to improve axial stability between the hub and housing.

28 Claims, 6 Drawing Sheets

HARMONIC DRIVE CAMSHAFT PHASER WITH IMPROVED RADIAL STABILITY

RELATIONSHIP TO OTHER APPLICATIONS AND PATENTS

This application is a Continuation-In-Part of a pending U.S. patent application Ser. No. 12/536,575, filed Aug. 6, 2009 and claims the benefit of U.S. Provisional Application No. 61/253,982, filed Oct. 22, 2009.

TECHNICAL FIELD

The present invention relates to an oil-less camshaft phaser, referred to herein as an "electric variable cam phaser" (eVCP), wherein a harmonic gear drive unit (HD) is controlled by an electric motor (eMotor) to vary the phase relationship between a crankshaft and a camshaft in an internal combustion engine; more particularly, to an eVCP including a bias spring to return the eVCP to a predetermined default phase position; and most particularly to an eVCP having improved housing radial support for the HD and the journal bearing by controlling housing distortion due to chain load without increasing the housing bulk.

BACKGROUND OF THE INVENTION

Camshaft phasers ("cam phasers") for varying the timing of combustion valves in internal combustion engines are well known. A first element, known generally as a sprocket element, is driven by a chain, belt, or gearing from an engine's crankshaft. A second element, known generally as a camshaft plate, is mounted to the end of an engine's camshaft.

U.S. Pat. No. 7,421,990 discloses an eVCP comprising first and second harmonic gear drive units facing each other along a common axis of the camshaft and the phaser and connected by a common flexible spline (flexspline). The first, or input, harmonic drive unit is driven by an engine sprocket, and the second, or output, harmonic drive unit is connected to an engine camshaft.

A first drawback of this arrangement is that the overall phaser package is undesirably bulky in an axial direction and thus consumptive of precious space in an engine's allotted envelope in a vehicle.

A second drawback is that two complete wave generator units are required, resulting in complexity of design and cost of fabrication.

A third drawback is that the phaser has no means to move the driven unit and attached camshaft to a phase position with respect to the crankshaft that would allow the engine to start and/or run in case of drive motor power malfunction. eVCPs have been put into production by two Japanese car manufacturers; interestingly, these devices have been limited to very low phase shift authority despite the trend in hydraulic variable cam phasers (hVCP) to have greater shift authority. Unlike hVCP, the prior art eVCP has no default seeking or locking mechanism. Thus, phase authority in production eVCPs to date has been undesirably limited to a low phase angle to avoid a stall or no-restart condition if the rotational position of the eVCP is far from an engine-operable position when it experiences eMotor or controller malfunction.

U.S. patent application Ser. No. 12/536,575 (parent to the present application), discloses an eVCP camshaft phaser comprising a flat HD having a circular spline and a dynamic spline linked by a common flexspline within the circular and dynamic splines, and a single wave generator disposed within the flexspline. The circular spline is connectable to either of an engine crankshaft sprocket or an engine camshaft, the dynamic spline being connectable to the other thereof. The wave generator is driven selectively by an eMotor to cause the dynamic spline to rotate past the circular spline, thereby changing the phase relationship between the crankshaft and the camshaft. The eMotor may be equipped with an electromagnetic brake. At least one coaxial coil spring is connected to the sprocket and to the phaser hub and is positioned and tensioned to bias the phaser and camshaft to a default position wherein the engine can run or be restarted should control of the eMotor be lost, resulting in the eMotor being unintentionally de-energized or held in an unintended energized position. In one aspect of the invention, the spring is contained in a spring cassette for easy assembly into the eVCP.

It has been shown that the HD as disclosed is well suited to operate satisfactorily under anticipated torque loading. However, a shortcoming of the disclosed invention is that if the HD is exposed to radial loading or bending, loading the splines within, the HD may become overstressed, causing the flex spline surface to yield, potentially leading to binding of the gear reducer.

What is needed in the art is an eVCP including means for increasing housing radial support for the journal bearing and the HD to control housing distortion due to input loading. Preferably, such support provided without increasing the housing bulk.

It is a principal object of the present invention to minimize housing distortion of an eVCP from radial loading or bending loading.

SUMMARY OF THE INVENTION

Briefly described, housing distortion and consequent eVCP failure is overcome by providing additional radial support behind the journal bearing without dimensional (select fit) matching of mating parts. This is beneficial for mass and size (packaging) of the eVCP. Depending upon the engine application, there are a number of ways to obtain this radial support that are readily integrated into existing features of the device and therefore are very economical.

Improved stiffening and minimized distortion of the eVCP housing is accomplished by providing a plurality of radial housing stiffeners formed into the housing around the motor mount end to prevent distortion of the spline ring bolted to the housing. Similar radial stiffeners may be formed on the output hub. In addition, the length and diameter of the journal bearing interface between the input housing and the output hub are selected to optimize axial stability of the eVCP.

In the existing design, the back plate is press fit into the rear of the housing to support the journal bearing against radial deformation. However, this presents a problem when applying a press fit directly in a region where journal bearing/hub clearance control is critical. The resulting elastic deformation of the housing bore can open the journal bearing clearance to a level where the HD would be compromised. One solution for this would be to match grind or select fit the back plate to the housing bore, but this would be prohibitively costly. In the present invention, a straight axial knurl is applied to the axial surface of the back plate, which knurl permits a larger tolerance-higher press fit class to be used without resulting in significant deformation of the housing. This is controlled by having the knurled plate harder than the housing. The high points of the knurl then plastically deform (or plow) the housing material during insertion into the bore, resulting in less radial deformation of the bore which is immediately adjacent to the journal bearing. Alternately, the knurl may be instead applied to the internal diameter of the housing bore that receives the back plate. In that embodiment, the knurl in the housing is made to be harder than the mating back plate material.

In an alternative embodiment, the sprocket and back plate are formed as a one-piece unit that, when affixed to the rear of the housing, supports the housing against radial deformation.

BRIEF DESCRIPTION OF THE DRAWINGS

The present invention will now be described, by way of example, with reference to the accompanying drawings, in which.

The exemplifications set out herein illustrate currently preferred embodiments of the invention. Such exemplifications are not to be construed as limiting the scope of the invention in any manner.

DESCRIPTION OF THE PREFERRED EMBODIMENTS

Figures 1A, 1B:
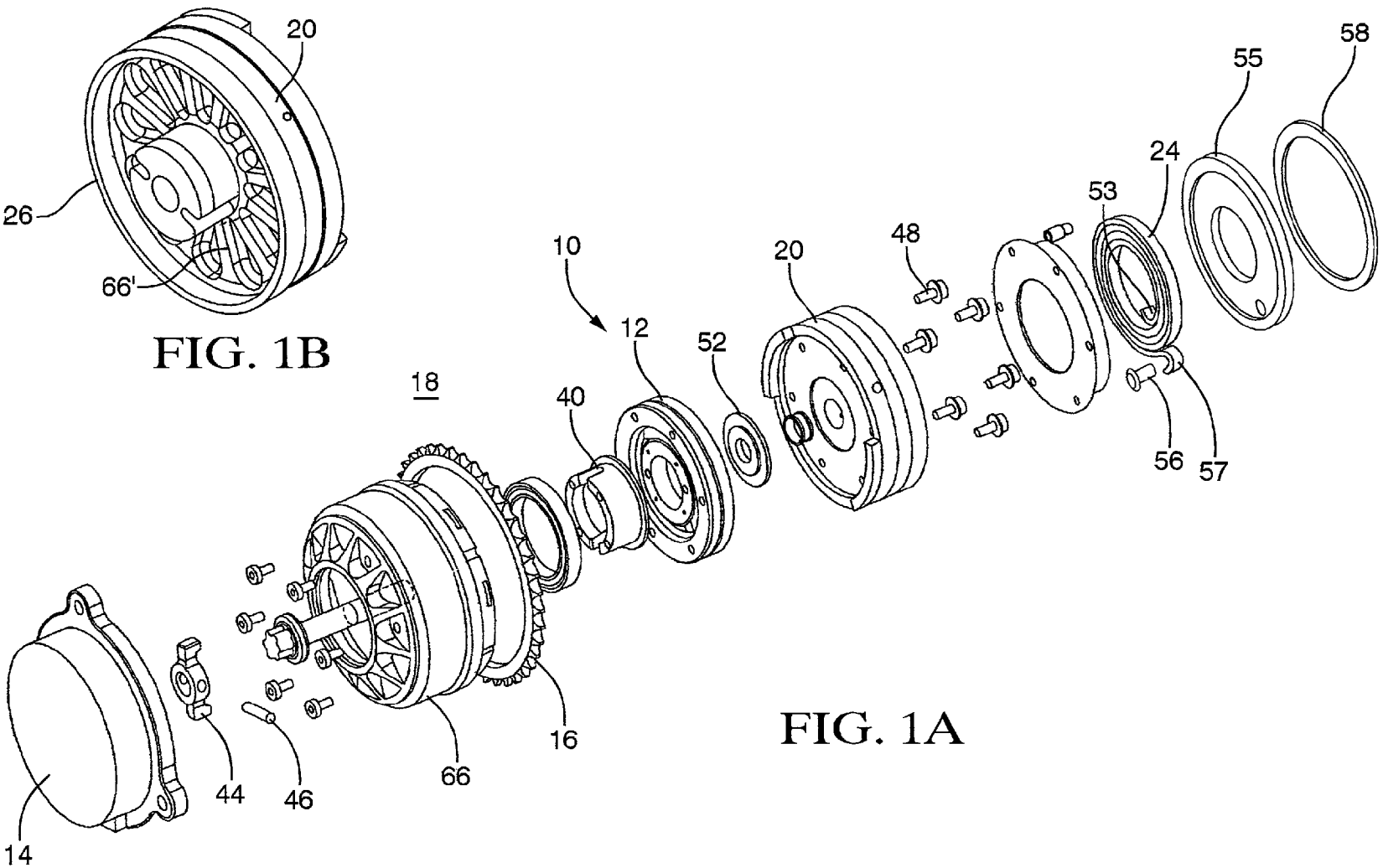
FIG. 1A is an exploded isometric view of an eVCP in accordance with the present invention, showing a first embodiment for attaching a back plate to the eVCP housing.
FIG. 1B is an isometric view of the reverse side of the output hub shown in FIG. 1A, in accordance with the invention.
Figure 2:
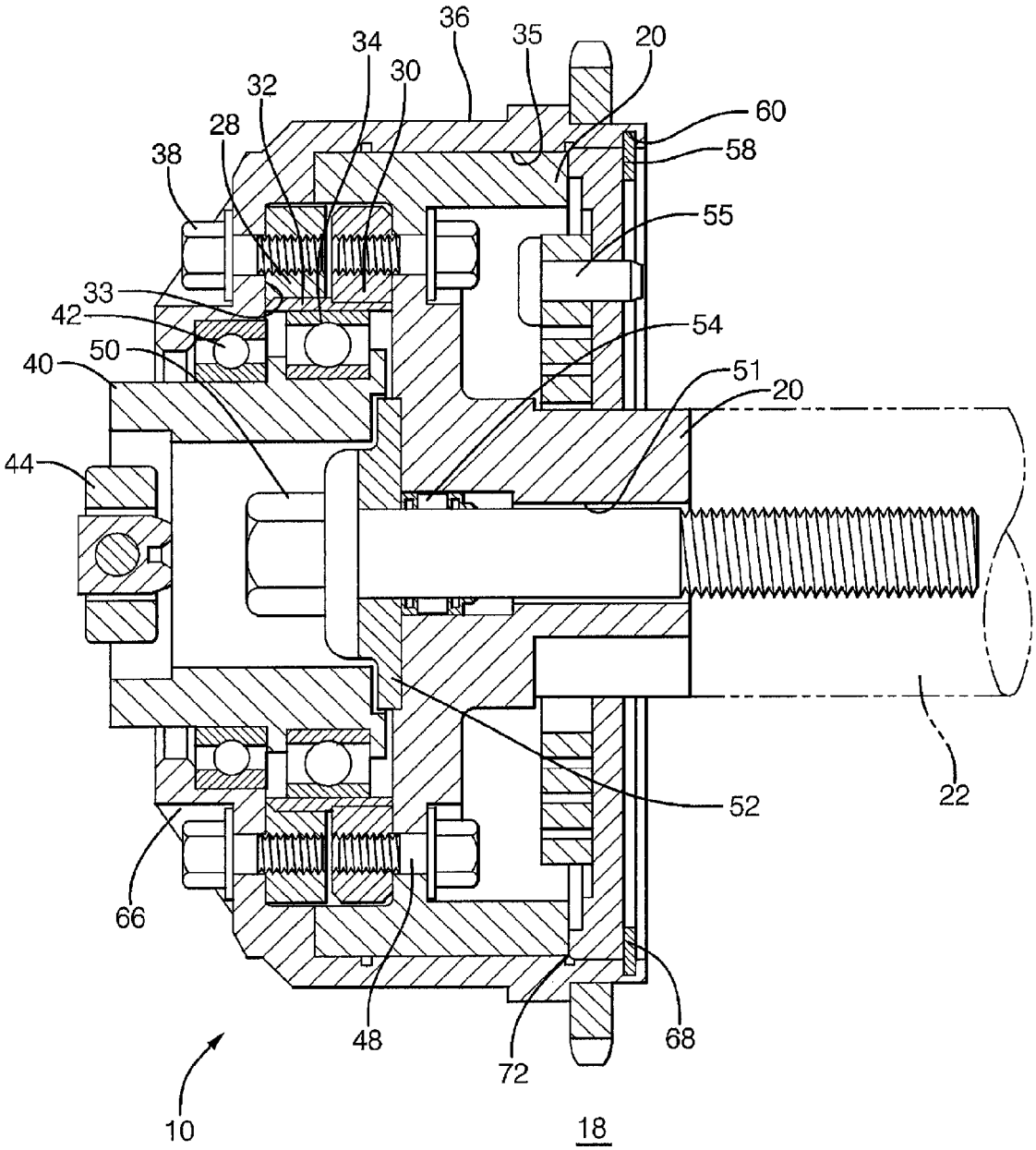
FIG. 2 is a first elevational cross-sectional view of the eVCP shown in FIG. 1A.
Figure 3:
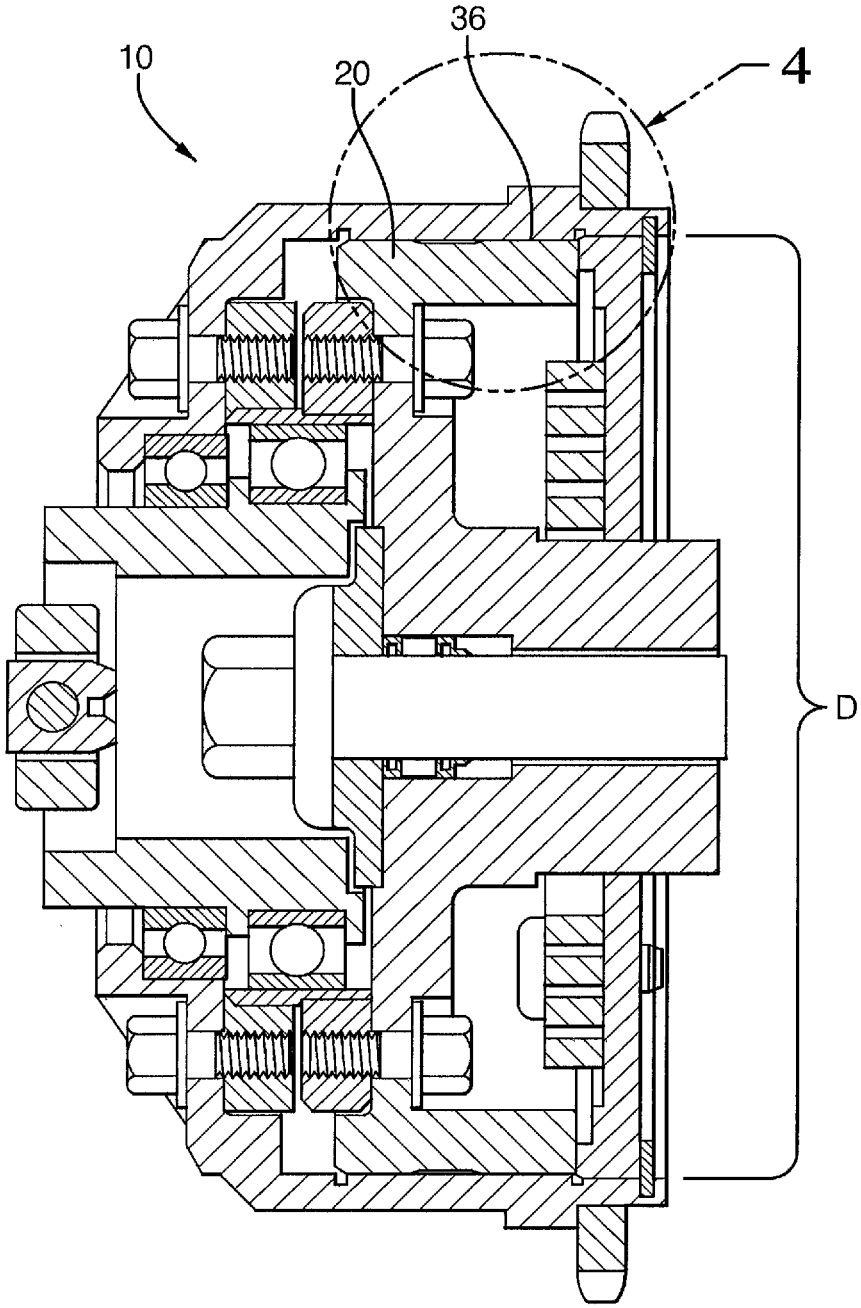
FIG. 3 is second elevational cross-sectional view of the eVCP shown in FIG. 1A.
Figure 4:
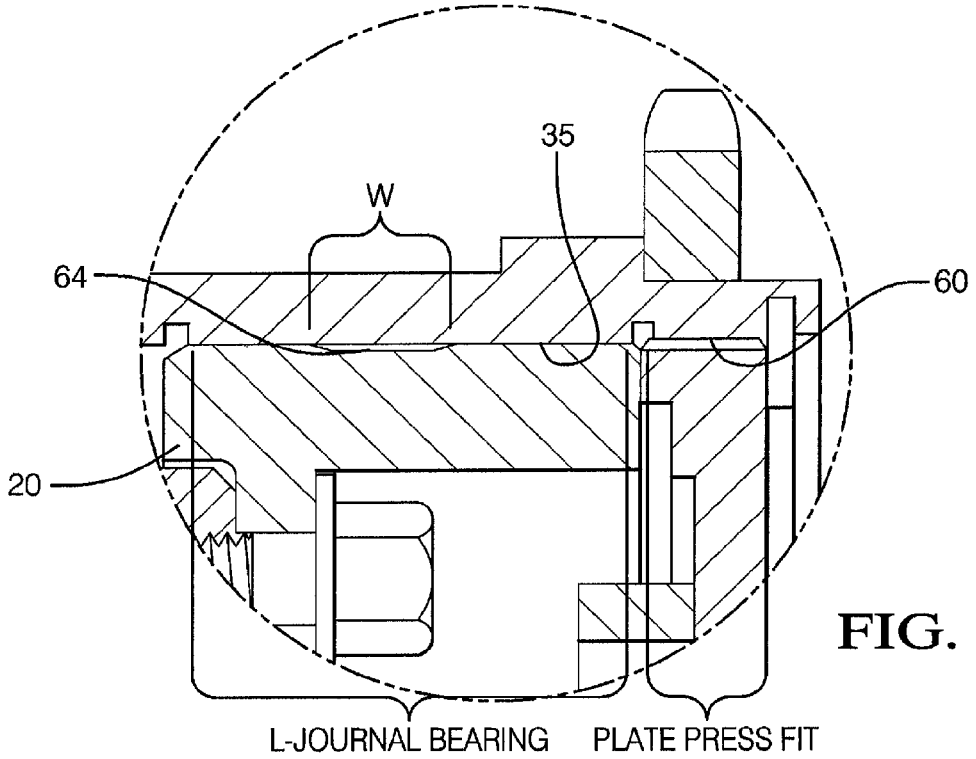
FIG. 4 is a first enlarged portion of FIG. 3.
Figure 5:
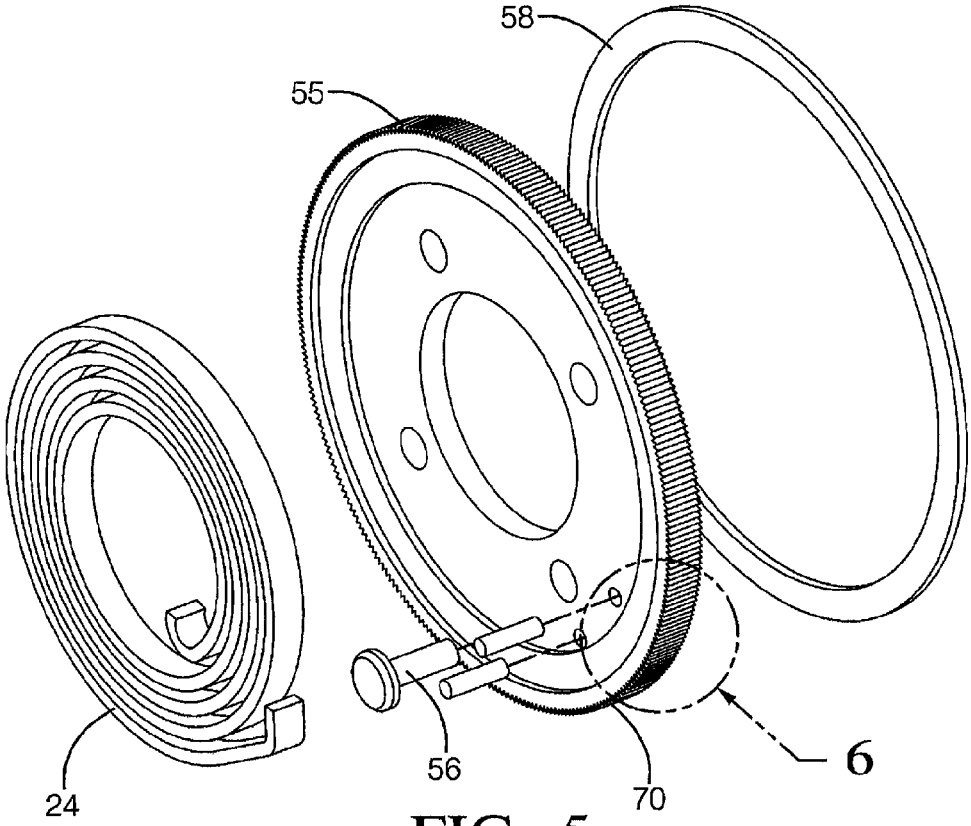
FIG. 5 is an exploded isometric view of a second enlarged portion of FIG. 3, also seen in FIG. 1A.
Figure 6:
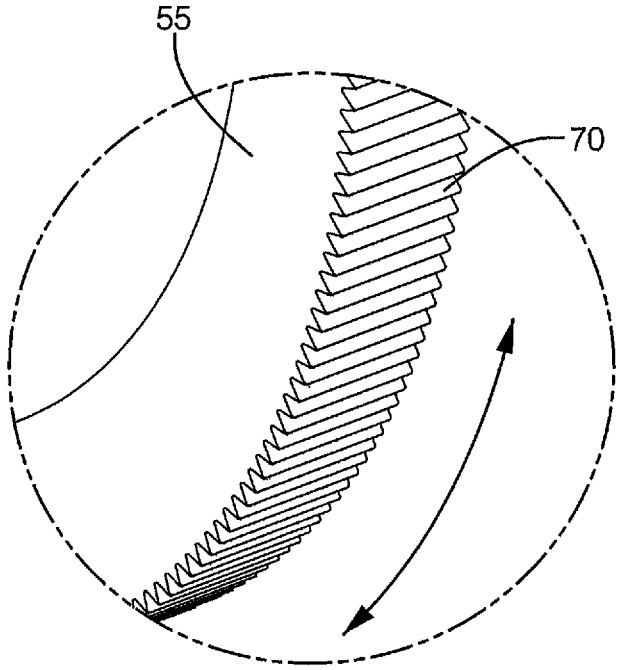
FIG. 6 is an enlarged portion of FIG. 5.

Referring to FIGS. 1A and 2, an eVCP 10 in accordance with the present invention comprises a flat harmonic gear drive unit (HD) 12; a rotational actuator 14 that may be a hydraulic motor but is preferably a DC electric motor (eMotor), operationally connected to harmonic gear drive unit 12; an input sprocket 16 operationally connected to harmonic gear drive unit 12 and drivable by a crankshaft of engine 18; an output hub 20 attached to harmonic gear drive unit 12 and mountable to an end of an engine camshaft 22; and a bias spring 24 operationally disposed between output hub 20 and input sprocket 16. actuator 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28,30 and having outwardly-extending gear teeth disposed for engaging inwardly-extending gear teeth on both first and second splines 28,30; and a wave generator 34 disposed radially inwards of and engaging flexspline 32.

Flexspline 32 is a non-rigid ring with external teeth on a slightly smaller pitch diameter than the circular spline. It is fitted over and elastically deflected by wave generator 34.

The circular spline is a rigid ring with internal teeth engaging the teeth of flexspline 32 across the major axis of wave generator 34.

The dynamic spline is a rigid ring having internal teeth of the same number as flexspline 32. It rotates together with flexspline 32 and, in the example shown, serves as the output member. Either the dynamic spline or the circular spline may be identified by a chamfered corner 33 at its outside diameter to distinguish one spline from the other.

As is disclosed in the prior art, wave generator 34 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of a harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 means that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 34.

Of course, as will be obvious to those skilled in the art, the circular spline rather may have slightly more teeth than the dynamic spline has, in which case the rotational relationships described below are reversed.

Still referring to FIGS. 1A and 2, sprocket 16 is supported by a generally cup-shaped sprocket housing 36 that is fastened by bolts 38 to first spline 28. A coupling adaptor 40 is mounted to wave generator 34 and extends through sprocket housing 36, being supported by bearing 42 mounted in sprocket housing 36. A coupling 44 mounted to the actuating shaft of actuator 14 and pinned thereto by pin 46 engages coupling adaptor 40, permitting wave generator 34 to be rotationally driven by actuator 14, as may be desired, to alter the phase relationship between first spline 28 and second spline 30.

Hub 20 is fastened to second spline 30 by bolts 48 and may be secured to camshaft 22 by a central through-bolt 50 extending through an axial bore 51 in hub 20 and capturing a stepped thrust washer 52 and a filter 54 recessed in hub 20.

In an eVCP, it is necessary to limit radial run-out between the input housing 36 and output hub 20. In the prior art, this has been done by providing multiple roller bearings to maintain concentricity between the input and output hubs. Referring to FIG. 2, in accordance with the present invention, radial run-out is limited by a singular journal bearing interface 35 between a substantially cylindrical inner surface of housing 36 and a close-fitting and substantially cylindrical outer surface of output hub 20, thereby reducing the overall axial length of eVCP 10 and its cost to manufacture over a prior art eVCP having multiple roller bearings. Improved structural control of this radial runout, as described below, is a further object of the present invention.

Back plate 55 captures spring 24 against hub 20. Inner spring tang 53 is engaged by hub 20, and outer spring tang 57 is attached to back plate 55 by pin 56. As described in the pending parent application Ser. No. 12/536,575, back plate 55 may be attached via snap ring 58 disposed in an annular groove 60 formed in housing 36.

In the event of an actuator malfunction, spring 24 is biased to back-drive harmonic gear drive unit 12 without help from actuator 14 to a rotational position of second spline 30 wherein engine 18 will start or run, which position may be at one of the extreme ends of the range of authority or intermediate of the phaser's extreme ends of its rotational range of authority. For example, the rotational range of travel in which spring 24 biases harmonic gear drive unit 12 may be limited to something short of the end stop position of the phaser's range of authority. Such an arrangement would be useful for engines requiring an intermediate park position for idle or restart.

Figure 7:
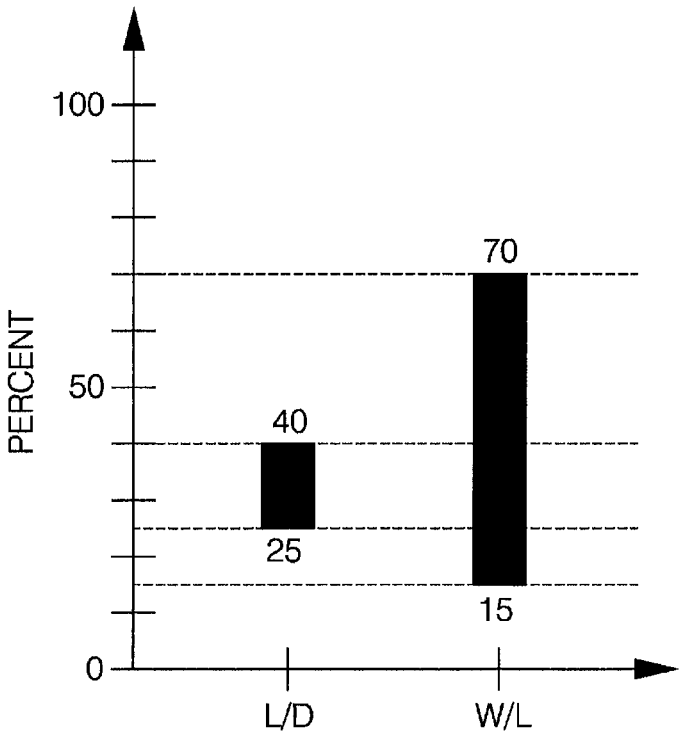
FIG. 7 is a bar graph showing currently preferred ranges of component dimensions.

Referring now to FIGS. 3 through 8, the nominal diameter of output hub 20 is D; the nominal axial length of the journal bearing interface 35 is L; and the nominal axial length of the oil groove 64 formed in either hub 20 (shown) and/or in housing 36 (not shown) for supplying oil to journal bearing interface 35 is W. In addition to journal bearing clearance, the length of the journal bearing in relation to hub diameter controls how much the output hub 20 can tip within housing 36. The width of the oil feed groove in relation to journal bearing length controls how much bearing contact area is available to carry the radial load. Experimentation has shown that a currently preferred range of the ratio L/D is between about 0.25 and about 0.40, and that a currently preferred range of the ratio W/L is between about 0.15 and about 0.70, as shown in FIG. 7.

As noted above, an important consideration for an eVCP is resistance of housing 36 to distortion caused by radial forces. First spline 28 is bolted to housing 36, so distortion of housing 36 results in spline ring distortion which causes undesirable local radial loading of the HD spline. Accordingly, a plurality of radial housing stiffeners 66 (FIGS. 1A-2) are formed into the housing around the actuator mount end. In addition, since second spline 30 is bolted to output hub 20, any distortion of hub 20 can be translated to spline 30 and cause radial loading of the HD spline. Accordingly, a similar plurality of stiffening features 66' may be formed in cover 26 of hub 20 (FIG. 1B).

Further, stiffening in the region of the journal bearing interface 35 is provided by making back plate 55 a structural element supportive of bore 68 (FIG. 2) in housing 36 which forms the input housing portion of journal bearing interface 35.

As noted above, press-fitting the back plate into the rear of the housing makes the back plate a structural element which defines the shape of bore 68 and the input housing portion of journal bearing interface 35. However, obtaining a conventional press fit between back plate 55 and housing 36 in an area immediately next to journal bearing interface 35 presents a significant problem. A straight press fit in the range of even the lightest type of guaranteed press joint (LN3) has a maximum interference twice the maximum tolerable journal bearing clearance. The resulting elastic deformation of the housing bore would open the clearance at the journal bearing interface to a level where the bearing interface 35 and the HD would be compromised. One solution for this would be to match grind or select fit the plate to the housing bore, which would be prohibitively costly. It has been determined experimentally that a bearing clearance in the range of fit class RC1 is required to control the axial runout and axial parallelism of the two splines to a level where the HD is not subjected to radial or bending loading.

Figure 8:
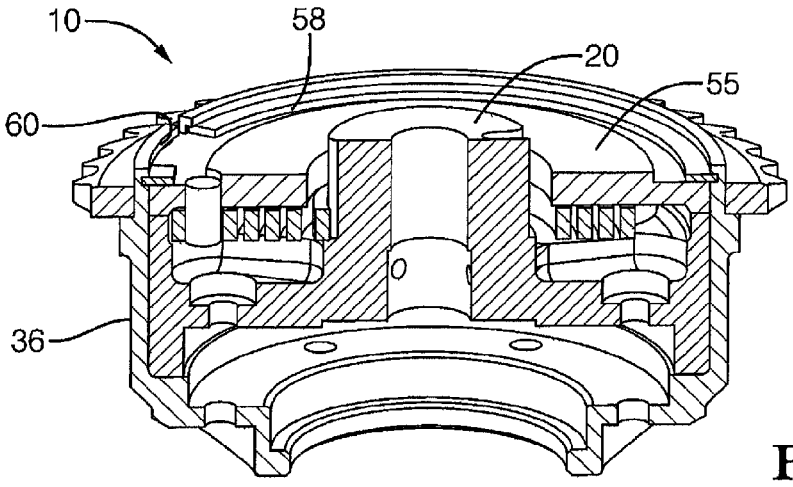
FIG. 8 is an isometric view, partially in section, of a first embodiment for attaching a back plate to the eVCP housing.

The solution to this problem in accordance with the present invention is to apply a straight axial knurl 70 to the axial surface of back plate 55. Knurl 70 permits a larger tolerance, higher press fit class in the range of FN3 to be used without resulting in significant deformation of bore 68. This is controlled by having the material of the knurled back plate harder than the material of the housing forming bore 68. The high points of the knurl then plastically deform (or plow) the housing material during insertion of the back plate, resulting in less radial deformation of bore 68 which is immediately adjacent to journal bearing interface 35. With this solution, the maximum press fit can be taken to 5-6X the maximum journal bearing clearance without causing distortion problems. This can be accomplished without mating or select fitting the components. To accommodate this plowing of material and to prevent plowed material from fouling the journal bearing clearance, a small annular groove 72 is placed between the press fit region and the journal bearing region (FIG. 2) to harmlessly receive and store any plowed material. In an alternate embodiment, the knurl may be applied to the internal diameter of the housing bore that receives the back plate. In that embodiment, the knurl in the housing would be made to be harder than the mating back plate material thereby causing the mating surface of the back plate to be plastically deformed by the knurled housing. In either case, snap ring 58 may be installed in annular groove 60 to further secure back plate 58 to housing 36, as shown in FIG. 8.

A further benefit of this improved design is that the axial knurled press fit joint is very resistant to radial slippage of the joint. This characteristic also increases radial stiffness between back plate 55 and housing 36 resulting from back plate 55 being the anchor point for torsional bias spring 24.

Figure 9:
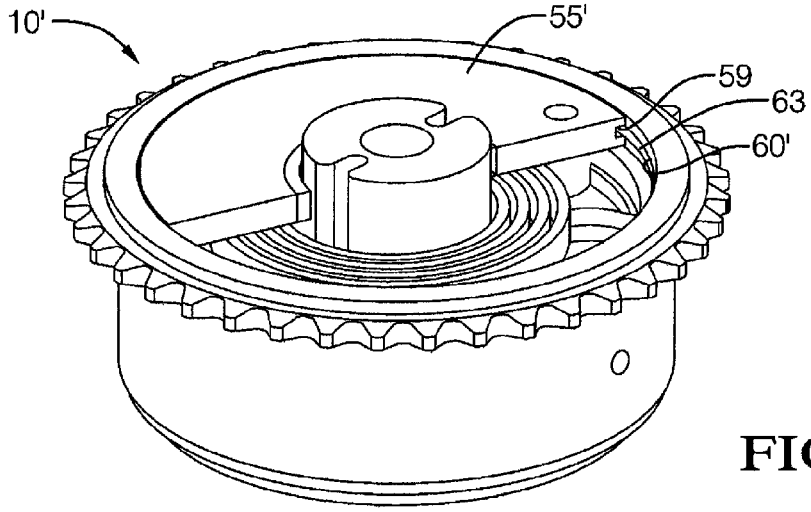
FIG. 9 is a second isometric view, partially in section, of a second embodiment for attaching a back plate to the eVCP housing.
Figure 10:
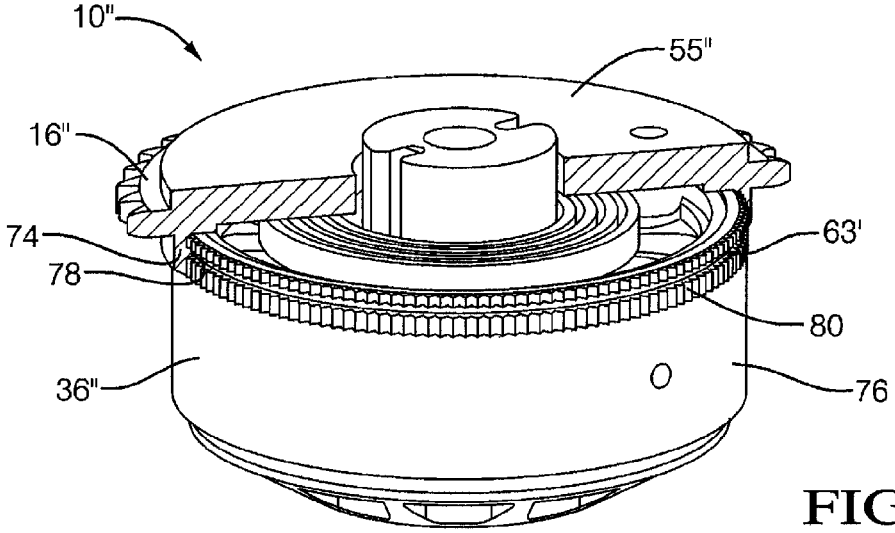
FIG. 10 is a third isometric view, partially in section, of a third embodiment for attaching a back plate to the eVCP housing.

Referring now to FIGS. 9-10, two alternative embodiments 10',10" are shown for supporting the input housing against radial deformation, by using the back plate as a structural element.

In FIG. 9, back plate 55' may be provided with a circumferential annular groove 59 containing an internal wire type retaining ring 63 that lodges partially in housing groove 60'.

In FIG. 10, back plate 55" is formed integrally with sprocket 16" and includes a circular flange 74 extending axially around the outer surface 76 of housing 36". Internal diameter 78 of flange 74 is press-fitted onto knurl 80 formed in the outer surface of sprocket housing 36". Optionally, internal wire type retaining ring 63' may be used to secure integral back plate/sprocket 55" to housing 36" by being lodged in grooves in flange 74 and outer surface 76.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser for controllably varying the phase relationship between a crankshaft and a camshaft in an internal combustion engine, comprising:

a hub having a substantially cylindrical outer surface of a diameter D1;

a housing having a diameter D2, said diameter having a substantially cylindrical inner surface, wherein said housing is configured for rotably receiving said hub, in a close fit, wherein said substantially cylindrical inner surface of said housing diameter is adjacent a substantial portion of said substantially cylindrical outer surface of said hub to define a journal bearing interface, and wherein said journal bearing interface has a length L; and a harmonic gear drive unit having an input element and an output element, wherein said input element is connected to one of said hub and said housing and wherein said output element is connected to the other of said hub and said housing;

wherein the ratio of length L to diameter D1 is selected to provided axial stability between said hub and said housing; and wherein the ratio of length L to diameter D1 is equal to or greater than approximately 0.25.

2. A camshaft phaser in accordance with claim 1 wherein one of said substantially cylindrical outer surface or said substantially cylindrical inner surface includes an oil groove having a width W.

3. A camshaft phaser in accordance with claim 1 wherein the ratio of length L to diameter D1 is between approximately 0.25 and approximately 0.40.

4. A camshaft phaser in accordance with claim 2 wherein the ratio of width W to Length W is equal to or greater than approximately 0.15.

5. A camshaft phaser in accordance with claim 2 wherein the ratio of width W to length L is between approximately 0.15 and approximately 0.70.

6. A camshaft phaser in accordance with claim 1 wherein said crankshaft is configured for connection with one of said hub or said housing and wherein said camshaft is configured for connection with the other of said hub or said housing.

7. A camshaft phaser in accordance with claim 1 wherein said input element is one of a circullar spline or a dynamic spline and said output element is the other of said circular spline or said dynamic spline.

8. A camshaft phaser in accordance with claim 7 wherein said circular spline is attached to said housing and said dynamic spline is attached to said hub.

9. A camshaft phaser in accordance with claim 1 wherein said dynamic spline is attached to said housing and said circular spline is attached to said hub.

10. A camshaft phaser in accordance with claim 1 further comprising a plurality of radial stiffeners formed into said housing.

11. A camshaft phaser in accordance with claim 1 further comprising a plurality of radial stiffeners formed into said hub.

12. A camshaft phaser for controllably varying the phase relationship between a crankshaft and a camshaft in an internal combustion engine, comprising:

a hub having a substantially cylindrical outer surface of a diameter D1;

a housing having a diameter D2, said diameter having a substantially cylindrical inner surface, wherein said housing is configured for rotably receiving said hub, in a close fit, wherein said substantially cylindrical inner surface of said housing diameter is adjacent a substantial portion of said substantially cylindrical outer surface of said hub to define a journal bearing interface, and wherein said journal bearing interface has a length L; and a harmonic gear drive unit having an input element and an output element, wherein said input element is connected to one of said hub and said housing and wherein said output element is connected to the other of said hub and said housing;

wherein the ratio of length L to diameter D1 is selected to provided axial stability between said hub and said housing;

wherein said housing includes an axial bore; and wherein said camshaft phaser further comprises a back plate fitted within said bore.

13. A camshaft phaser in accordance with claim 12 wherein a first mating surface of one of said back plate or said housing is irregularly formed to engage a second surface of the other of said back plate or said housing during a press fitting between the surfaces.

14. A camshaft phaser in accordance with claim 13 wherein said irregularly formed surface is a knurl.

15. A camshaft phaser in accordance with claim 12 further comprising an expansion clip extending into a first annular groove in said bore for retaining said back plate in said bore.

16. A camshaft phaser in accordance with claim 14 further comprising a feature formed in said bore for collecting material removed by said knurl during insertion thereof into said bore.

17. A camshaft phaser in accordance with claim 13 wherein the material forming said irregularly formed first surface is harder than the material forming said second surface.

18. A camshaft phaser in accordance with claim 12 including a sprocket drivably connected to said crankshaft wherein said sprocket is integral with said back plate.

19. A camshaft phaser in accordance with claim 12 wherein one of said substantially cylindrical outer surface or said substantially cylindrical inner surface includes an oil groove having a width W.

20. A camshaft phaser in accordance with claim 19 wherein the ratio of width W to Length W is equal to or greater than approximately 0.15.

21. A camshaft phaser in accordance with claim 19 wherein the ratio of width W to length L is between approximately 0.15 and approximately 0.70.

22. A camshaft phaser in accordance with claim 12 wherein the ratio of length L to diameter D1 is between approximately 0.25 and approximately 0.40.

23. A camshaft phaser in accordance with claim 12 wherein said crankshaft is configured for connection with one of said hub or said housing and wherein said camshaft is configured for connection with the other of said hub or said housing.

24. A camshaft phaser in accordance with claim 12 wherein said input element is one of a circular spline or a dynamic spline and said output element is the other of said circular spline or said dynamic spline.

25. A camshaft phaser in accordance with claim 24 wherein said circular spline is attached to said housing and said dynamic spline is attached to said hub.

26. A camshaft phaser in accordance with claim 12 wherein said dynamic spline is attached to said housing and said circular spline is attached to said hub.

27. A camshaft phaser for controllably varying the phase relationship between a crankshaft and a camshaft in an internal combustion engine, comprising:

a) a hub having a substantially cylindrical outer surface of a diameter D1 and a bore;

b) a housing having a diameter D2, said diameter having a substantially cylindrical inner surface, wherein said housing is configured for rotably receiving said hub, in a close fit, wherein said substantially cylindrical inner surface of said housing diameter is adjacent a substantial portion of said substantially cylindrical outer surface of said hub to define a journal bearing interface, said interface configured to provide axial stability between said hub and housing, c) a harmonic gear drive unit having an input element and an output element, wherein said input element is connected to one of said hub and said housing and wherein said output element is connected to the other of said hub and said housing; and d) a back plate fitted within said bore adjacent said hub.

28. A camshaft phaser in accordance with claim 27, further comprising:

a) at least one spring operationally connected to said circular spline and to said dynamic spline for urging one of said circular and dynamic splines to move said camshaft phaser to a default rotational position;

b) a sprocket rotatably fixed to said housing and being connectable to said crankshaft; and c) an oil groove formed in one of said hub or said journal bearing for said hub, wherein said oil groove has an axial width W, and wherein the ratio W/L is between about 0.15 and about 0.70.

* * * * *